US008997942B2

(12) United States Patent
Fritz

(10) Patent No.: US 8,997,942 B2
(45) Date of Patent: Apr. 7, 2015

(54) WELL CARCASS FOR AN ELEVATOR INSTALLATION

(75) Inventor: Volker Fritz, Schwalbach/Ts (DE)

(73) Assignee: Thoma Aufzuge GmbH, Frankufurt, A.M. (DE)

( * ) Notice: Subject to any disclaimer, the term of this patent is extended or adjusted under 35 U.S.C. 154(b) by 157 days.

(21) Appl. No.: 13/131,951

(22) PCT Filed: Dec. 16, 2009

(86) PCT No.: PCT/EP2009/009050

§ 371 (c)(1),
(2), (4) Date: May 31, 2011

(87) PCT Pub. No.: WO2010/069563

PCT Pub. Date: Jun. 24, 2010

(65) Prior Publication Data

US 2011/0266413 A1 Nov. 3, 2011

(30) Foreign Application Priority Data

Dec. 18, 2008 (DE) ..... 10 2008 063 529
Oct. 9, 2009 (DE) ..... 10 2009 048 989

(51) Int. Cl.
*B66B 11/00* (2006.01)
*B66B 7/00* (2006.01)
(Continued)

(52) U.S. Cl.
CPC ..... *B66B 7/023* (2013.01); *B66B 11/0005* (2013.01); *E04F 17/005* (2013.01)

(58) Field of Classification Search
CPC ..... B66B 7/00; B66B 7/10; B66B 9/00; B66B 11/00; B66B 11/005; B66B 7/023
USPC ..... 187/900, 414, 256, 401, 255, 264; 256/286, 294, 295
See application file for complete search history.

(56) References Cited

U.S. PATENT DOCUMENTS 5,535,852 A * 7/1996 Bishop et al. ..... 187/336
6,035,974 A 3/2000 Richter et al.
(Continued)

FOREIGN PATENT DOCUMENTS

DE 1174470 A 7/1964
EP 1 448 470 B1 8/2004
(Continued)

OTHER PUBLICATIONS

Machine Translation of JP 2000-143132.*
(Continued)

*Primary Examiner* — William E Dondero
*Assistant Examiner* — Diem Tran
(74) *Attorney, Agent, or Firm* — Antonelli, Terry, Stout & Kraus, LLP.

(57) ABSTRACT

The invention relates to a well carcass (102) for an elevator installation (103), which well carcass may be arranged so as to be free-standing and/or in an elevator well (100) and serves for receiving a load suspension means (200) which is moved upward and downward in the well carcass (102) with the aid of carrying means, in particular a traction device (208), via at least one drive shaft (204) connected to a drive motor (126) and mounted horizontally on the well carcass (102) or in the elevator well (100).
The object on which the invention is based is to produce the well carcass and the associated elevator installation in a simple and cost-effective way, along with optimal space utilization for the load suspension means.
The object is achieved, according to the invention, in that at least one drive shaft (204) extends approximately horizontally between two diagonally opposite corner regions (105) of the well carcass (102) and is connected indirectly or directly to opposite parts, in particular to longitudinal sides (109, 111, 113, 115), of the well carcass (102) or wall parts of the elevator well (100) and has in the region of each of its two ends a driving pulley (206) which moves the load suspension means (200) upward and downward in each case with the aid of a carrying means (208).

20 Claims, 12 Drawing Sheets

(51) Int. Cl.
*B66B 7/02* (2006.01)
*E04F 17/00* (2006.01)

(56) References Cited

U.S. PATENT DOCUMENTS

| | | | | |
|---|---|---|---|---|
| 6,679,013 | B2 | 1/2004 | Hornung | |
| 2006/0231350 | A1 | 10/2006 | Hashiguchi | |
| 2006/0260878 | A1 | 11/2006 | Hashiguchi | |
| 2007/0017003 | A1 | 1/2007 | Harris et al. | |
| 2007/0289821 | A1 * | 12/2007 | Ach | 187/404 |

FOREIGN PATENT DOCUMENTS

| | | | |
|---|---|---|---|
| EP | 1 741 660 | A1 | 1/2007 |
| EP | 1 935 826 | | 6/2008 |
| JP | 06-127868 | A | 5/1994 |
| JP | 2000-143132 | | 5/2000 |
| JP | 2003-002556 | A | 1/2003 |
| JP | 2005-314013 | | 11/2005 |
| WO | WO 99/43593 | | 9/1999 |
| WO | WO 2006/131947 | | 6/2006 |
| WO | WO 2008/110241 | | 9/2008 |

OTHER PUBLICATIONS

International Preliminary Report of Patentability dated Jun. 30, 2011 in English.

* cited by examiner

WELL CARCASS FOR AN ELEVATOR INSTALLATION

The invention relates to a well carcass for an elevator installation, which well carcass may be arranged so as to be free-standing and/or in an elevator well and serves for receiving a load suspension means which is moved upward and downward in the well carcass with the aid of carrying means, in particular a traction device, via at least one drive shaft connected to a drive motor and mounted horizontally on the well carcass or in the elevator well.

Simplified elevator installations for the disabled are already generally known. These are used predominantly in private living areas for the barrier-free transport of persons with disabilities and are also known in general linguistic use by the expression "homelift".

Due to a lack of a harmonized European standard, which up to now has been present only in the form of prEN 81-41:2007 as a draft for trials and for comments from the public, simplified elevator installations are produced and installed, for example, in Germany in accordance with the requirements of directive 2006/42/EC, also called the machine directive. This directive makes it possible, for example by the use of a dead man's control, that is to say the elevator can be moved only as long as an operating button is pressed manually, to dispense with a car closing door when a maximum operating speed is 0.15 m/s and further measures are adopted. Moreover, the machine directive makes it possible to carry out reduced overtravels (well heads) and undertravels (well pits).

The protective spaces required for the maintenance and inspection of the installations are produced temporarily. For elevator installations of this type, there is usually no need for safety-related acceptance by an appointed office up to a conveying height of 3 m, insofar as the manufacturing company has appropriate manufacturer's certificates. The conveying height is the maximum travel distance which the platform can cover.

Simplified elevator installations of this type can be mounted in elevator wells which are usually bricked in or concreted in. In most applications, however, these installations are delivered with an elevator well carcass. This can be mounted as a supporting or self-supporting well carcass inside or outside. The supporting well carcass structure is composed of stanchions or longitudinal struts and transoms in the form of steel profiles, normally hollow steel profiles. So as to obtain a protective device which is closed at least over the travel distance, well carcasses are often lined with glass, façade panels or other material.

Spindle drives and hydraulic drive systems are mainly offered as drive systems on the elevator market. In this case, the drive spindle or hydraulic ram and the guide system are mounted on a side wall or the rear wall side. The elevator platforms are guided so as to project on one side as a "rucksack system". The drive motor or hydraulic assembly is located either on the drive side behind cladding (spindle drives) or outside the elevator well (hydraulic assembly).

In both drive systems, a side wall or the rear wall is equipped with the required technology (drive spindle, hydraulic ram, guide rails, etc.). This wall side may be lined, if this is desirable for architectural reasons. A wall lining of this type is absolutely necessary when there are risks of shearing and crushing as a result of the traveling movement. In glass elevators, the transparency which is reduced as a result is felt to be troublesome.

Furthermore, the lined wall side cannot be used for possible car access and also requires additional construction space. Moreover, "rucksack systems" have poorer travel properties, as compared with centrally suspended systems, this being reflected, for example, by the stick/slip effect and resulting cage vibrations during the traveling movement. This leads, inter alia, to higher noise emissions which in residential buildings are detrimental to living comfort.

Furthermore, in an elevator installation with at least two halts, which has a drive motor with a vertically running drive shaft and with a driving pulley fastened to it and carrying means, is known from EP 1 741 660 A1. The elevator installation is equipped with an elevator platform which has a traveling frame and which is carried by the carrying means and is moved upward and downward. The carrying means for the elevator platform run, inter alia, diagonally from corner to corner and on both sides of the elevator installation, and therefore a large amount of construction space is required for the drive device. In the case of a step-up ratio of 2:1 or a greater step-up ratio, further construction space is required at the upper or lower well end. Moreover, this arrangement necessitates additional construction space for the deflecting rollers above or below the car. Furthermore, only ropes, usually steel ropes, can be used as carrying means, since the carrying means have to be bent at least twice through 90° about the rope axis. Also, more than two carrying means are required in order to absorb high carrying forces. The known installation also needs a counterweight. Additional construction space in the well cross section consequently becomes necessary. A drive device of this type entails a high outlay, is complicated and is therefore very costly to produce.

In the elevator installation according to U.S. Pat. No. 6,035,974, the drive motor with the horizontally running drive shaft is located above the elevator platform and the carrying means run on both sides of the mutually opposite side parts of the elevator platform. A large amount of construction space is required for arranging the guide system, the carrying means and the two counterweights. Arranging accesses on the longitudinal sides of the travel platform is ruled out.

Furthermore, reference is made to document JP 2000143132 which has a traction device for an elevator installation which can be installed in a well carcass (20) and can be arranged so as to be free-standing and/or in an elevator well and serves for receiving a load suspension means which is moved upward and downward in the well carcass with the aid of carrying means, in particular a traction device, via at least one drive shaft connected to at least one drive motor and mounted on the well carcass.

The traction device is in this case to be equipped as a pulley block, in particular a factor pulley block, with two or more, in particular with four, deflecting pulleys, the axes of which are arranged one below the other on an approximately vertically running plane, at least one deflecting pulley being mounted in the elevator well or on the well carcass above the elevator installation, a further deflecting pulley being mounted below the elevator installation in the elevator well or on the well carcass, and one or more, in particular two, deflecting pulleys being mounted on the side element of the load suspension means, in particular the travel platform.

Furthermore, there is to be anchoring for the traction means of the pulley block in the elevator well or on the well carcass above the elevator installation, and further anchoring for the traction means of the pulley block below the elevator installation is to be connected to the anchoring in the elevator well or on the well carcass.

However, the known arrangement according to JP 2000143132 lacks an important combination feature, specifically: "in that at least one drive shaft extends approximately horizontally between two diagonally opposite corner regions of the well carcass".

Furthermore, it is pointed out that the known arrangement according to JP 2000143132 contains no suggestion that there is anchoring for the traction means of the pulley block in the elevator well above the elevator installation, and further anchoring for the traction means of the pulley block below the elevator installation is connected to the anchoring in the elevator well. Both anchorings are connected to a well carcass framework, thus additionally increasing the cost of the installation on account of the outlay in terms of material.

The object on which the invention is based is to produce the well carcass and the associated elevator installation in a simple and cost-effective way, along with optimal utilization of space.

The object is achieved, according to the invention, in that at least one drive shaft extends approximately horizontally between two diagonally opposite corner regions of the well carcass and is connected indirectly or directly to opposite parts, in particular to longitudinal sides, of the well carcass or wall parts of the elevator well and has in the region of each of its two ends a driving pulley which moves the load suspension means upward and downward in each case with the aid of a carrying means. Sufficient free space is thereby afforded in a simple way for the load suspension means which may be designed as a travel platform. This is also achieved in that the drive shaft extends approximately horizontally through the well carcass and has in the region of each of its two ends a driving pulley which moves the load suspension means upward and downward in each case with the aid of a carrying means. Since the carrying means, the guide system and all further technical components are provided solely in the corner region of the well carcass, a very large free space is provided in the central region of the well carcass for the load suspension means, in particular for the travel platform.

For this purpose, it is advantageous that the cross section of the well carcass is of round, oval, polygonal, preferably square, design, and the carrying means assigned to the ends of the drive shafts run in the immediate vicinity of and parallel to at least the vertically running longitudinal sides of the well carcass which form the corner regions. For this purpose, advantageously, the corner regions of the travel platform, which are adapted to the inner cross section of the well carcass, are cut off, the two longitudinal sides of the well carcass which converge in the corner region and the opposite end edge of the travel platform, when the latter has a rectangular or square base area, provide a free space which is triangular, as seen from above, and in which the carrying means, the guide system and the brake system for the travel platform can be accommodated optimally. Since the triangular area requires very little space in order to place the carrying means at this location, the access openings to the travel platform are also optimally increased in size. Overall, optimal space utilization for the necessary technology of the overall installation is achieved in the smallest possible space. In this way, more than 70% of the erection area of the installation can be made available for the travel platform. The use of a square platform also appreciably simplifies an architect's planning, since it can be made available for the travel platform. The use of a square platform also appreciably simplifies an architect's planning, since it can integrate a structure of this type in a building without problems. Moreover, the device according to the invention affords optimal access to the travel platform on all four sides at all the halts. For the elevator installation to be used by a wheelchair user, the square basic shape of the travel platform offers an optimal possibility for turning. This movement is circular, and therefore the slanted corners of the car walls are not required.

For this purpose, it is advantageous that a drive shaft or two drive shafts oriented coaxially with one another extend between the mutually opposite corner regions of the well carcass and are operatively connected to the drive motor, or that each drive shaft is operatively connected in each case to a drive motor. The drive shaft may advantageously be designed as a one-part continuous drive shaft or so as to be divided in two or else two drive shafts may be provided. Advantageously, the one-part drive shaft is supported at its two outer ends on the well carcass or on the walls of the elevator well. If the drive shaft is divided in two, it may be supported at the outer end of the well carcass or on the walls of the elevator well and be supported with its inner ends on a cross member which is arranged in the upper region of the well carcass and which also serves for receiving the drive motor. Since a free space is provided in the two mutually opposite corner regions, it is possible, as already mentioned, for the carrying means with the associated deflecting or driving pulleys, and the guide system of the travel platform to be provided in the corner region or in the carcass corners of the well carcass advantageously and in a space-saving manner. Furthermore, what is also achieved by this measure is that the bending moments acting on the drive shaft can be kept very low, and therefore the drive shaft does not need to have as high a dimensioning as hitherto. Material costs can thereby likewise be saved.

According to a development of the invention, an additional possibility is that the drive motor has an output shaft, the axis of rotation of which is arranged approximately at right angles to an axis of rotation of the drive shaft of the carrying means, in particular the traction device. Optimal space utilization for the drive assemblies is thereby obtained.

Furthermore, it is advantageous that the load suspension means is a travel platform which has at least two side elements which stand upright in the end edge region and/or in the corner region of the travel platform and which are connected to the carrying means.

It is also advantageous that the carrying means is arranged between side elements of the travel platform and longitudinal sides of the well carcass which form the corner region. The advantageously placed side elements make it possible to have optimally large passage openings on all four sides of the travel platform. At the same time, they also serve as a protective device, since they cover the carrying means provided in the corner regions and protect people located on the load suspension means, in particular the travel platform, since they prevent them from coming into contact with the carrying means.

It is also advantageous that the traction device is designed as a pulley block and has one or more deflecting pulleys, and all the axes of the deflecting pulleys are arranged one below the other approximately on a vertically running plane. The pulley block can thereby be accommodated in the corner region of the travel platform and well carcass in a simple and space-saving way.

It is especially important for the present invention that chains, steel ropes or toothed belts can be used as traction means for the traction device, in particular the pulley block. The traction means are fixed in the end positions merely by means of releasable clamping holders, so that the counterweights hitherto necessary may be dispensed with so as to save space and money. The advantage of using toothed belts is that, even after lengthy use, they do not stretch, do not slip and can be used with low amounts of noise. Furthermore, toothed belts are resistant to various environmental influences, such as very high or low temperatures, solar radiation, humidity, etc., and do not have to be maintained.

Furthermore, it is advantageous that the pulley block has a step-up ratio of 1:1, 2:1, 3:1, 4:1, 5:1 or greater. The advantageous use of a pulley block with the corresponding step-up ratio and the design of a weight-reducing load suspension means in the form of a platform composed of a floor and of a peripheral frame also make it possible to dispense with counterweights and nevertheless keep the drive powers low. With an external dimension of the travel platform of approximately 1.4×1.4 m and with the corresponding step-up ratio of 2:1, a low traveling speed and the low mass of the travel platform, the drive motor manages with a drive power of only approximately 2 kW. Advantageously, frequency control may also be used, and the three phases which the drive requires can thereby be generated via the frequency control and the starting current can be reduced. The elevator installation can consequently be connected to conventional plug sockets.

It is also advantageous that the load suspension means, in particular the travel platform, is guided in the well carcass with the aid of at least one guide, in particular a guide rail arranged on the well carcass, the guide being arranged at least in a corner region of the well carcass and/or in the immediate vicinity of the carrying means, in particular of the pulley block.

Furthermore, it is advantageous that the drive motor, together with the drive shaft, is arranged in a well head of the well carcass or in a well pit.

It is also advantageous that one or more access openings on the travel platform can be closed with the aid of car walls and/or doors.

According to a development of the invention, an additional possibility is that the upright side elements of the travel platform are arranged in the corner region of the travel platform in such a way that a free access opening to the travel platform is present on at least four sides. Thus, a well carcass configured in this way, together with the travel platform adapted to the well carcass, can easily be mounted, free-standing, even on existing buildings or can subsequently be integrated in the building without major conversion work.

If desired, the access openings on the travel platform, if they are not required, may be provided with a car wall. This car wall does not have to fulfill any higher strength requirements. The car wall may be of filigree design, so that a glass wall can be implemented.

If the car walls are dispensed with or these are made of glass and, furthermore, the well carcass is provided on all sides with a glass lining, an architecturally attractive design with maximum possible transparency is obtained.

According to another embodiment, it is advantageous that the well carcass is composed of at least two diagonally opposite vertically running stanchions, on which the carrying means, guide rails and at least one upper and one lower deflecting pulley are arranged indirectly or directly, and that the well carcass and/or the diagonally opposite vertically running stanchions and/or the cross member in the corner region of the well carcass are/is connected indirectly or directly to at least one inner wall of the elevator well. As a result, a highly cost-effective elevator installation which can easily be installed in an elevator well is obtained.

According to another embodiment, it is advantageous to have a traction device for an elevator installation which can be installed in a well carcass and may be arranged so as to be free-standing and/or in an elevator well and serves for receiving a load suspension means which is moved upward and downward in the well carcass with the aid of carrying means, in particular the traction device, via at least one drive shaft connected to at least one drive motor and mounted on the well carcass, wherein at least the one drive shaft extends approximately horizontally between two diagonally opposite corner regions of the well carcass and is connected indirectly or directly to opposite parts, in particular to longitudinal sides, of the well carcass or wall parts of the elevator well, and the traction device is equipped as a pulley block, in particular a factor pulley block, with two or more, in particular with four, deflecting pulleys, the axes of which are arranged one below the other on an approximately vertically running plane, at least one deflecting pulley being mounted in the elevator well or on the well carcass above the elevator installation, a further deflecting pulley being mounted below the elevator installation in the elevator well or on the well carcass, and one or more, in particular two, deflecting pulleys being mounted on a side element of the load suspension means, in particular the travel platform, wherein anchoring for the traction means of the pulley block in the elevator well or on the well carcass above the elevator installation, and further anchoring for the traction means of the pulley block below the elevator installation being connected to the anchoring in the elevator well or on the well carcass.

It is also advantageous that the carrying means, in particular the toothed belt, is bent in only one direction on all the deflecting pulleys. The toothed belt therefore also needs to be equipped with teeth on only one side, so that the service life of the toothed belt can be increased appreciably. As already mentioned, instead of the toothed belt, differently designed traction means, for example V-belts may also be used.

A cost saving is also achieved in that the two diagonally opposite guide rails, in a similar way to the cross member, are fastened to the well walls or to the inner wall of the elevator well directly and/or with the aid of a holder.

Further advantages and details of the invention are explained in the patent claims and the description and are illustrated in the figures.

In these:

FIG. 1 shows a perspective part view of the upper part of the well carcass for an elevator installation, which well carcass may be arranged so as to be free-standing and/or in an elevator well;

FIG. 2*a* shows the well carcass with a drive device arranged in the upper region, as a diagrammatic sectional illustration along the line A-A according to FIG. 5;

FIG. 2*b* shows a diagrammatic perspective illustration of the well carcass according to FIG. 2*a;*

Figure 1:
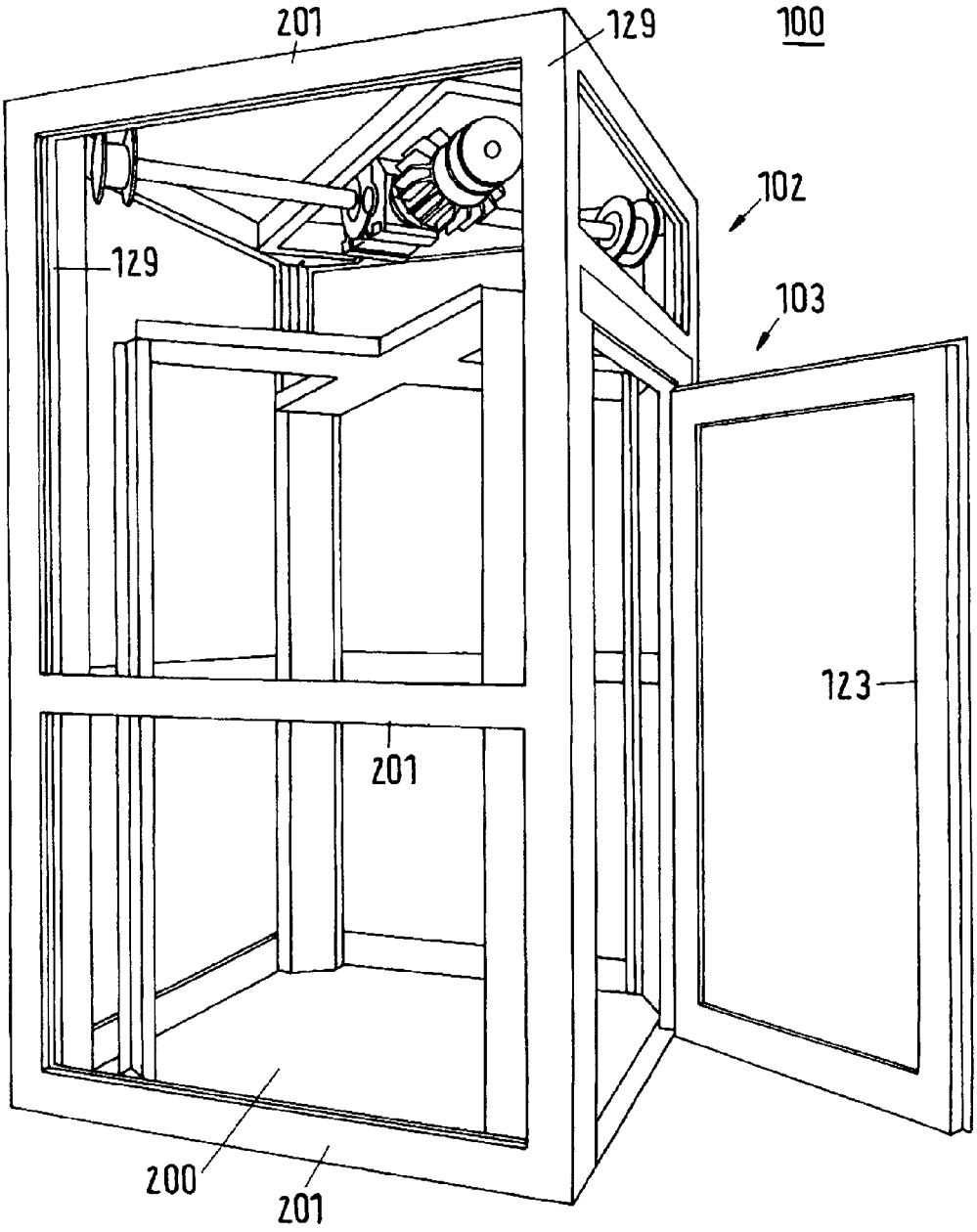

The drawing illustrates a well carcass 102 for an elevator installation 103, which well carcass may be arranged so as to be free-standing or in an elevator well 100. The well carcass 102 may be arranged in the elevator well 100 so as to be free-standing or may be supported with the aid of connecting elements on side walls of the elevator well 100 which are not illustrated in the drawing.

Figure 2A:
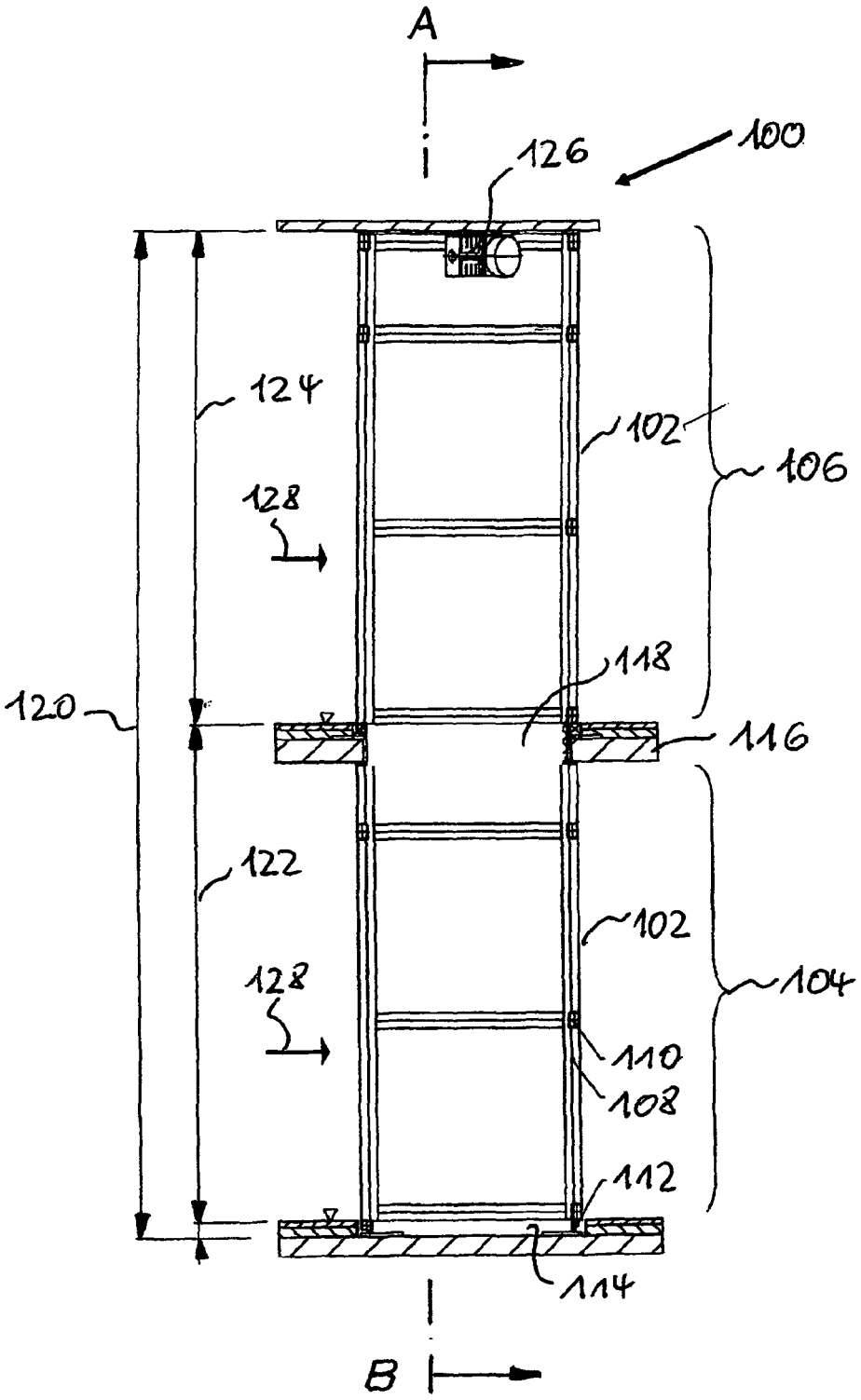
Figure 4:
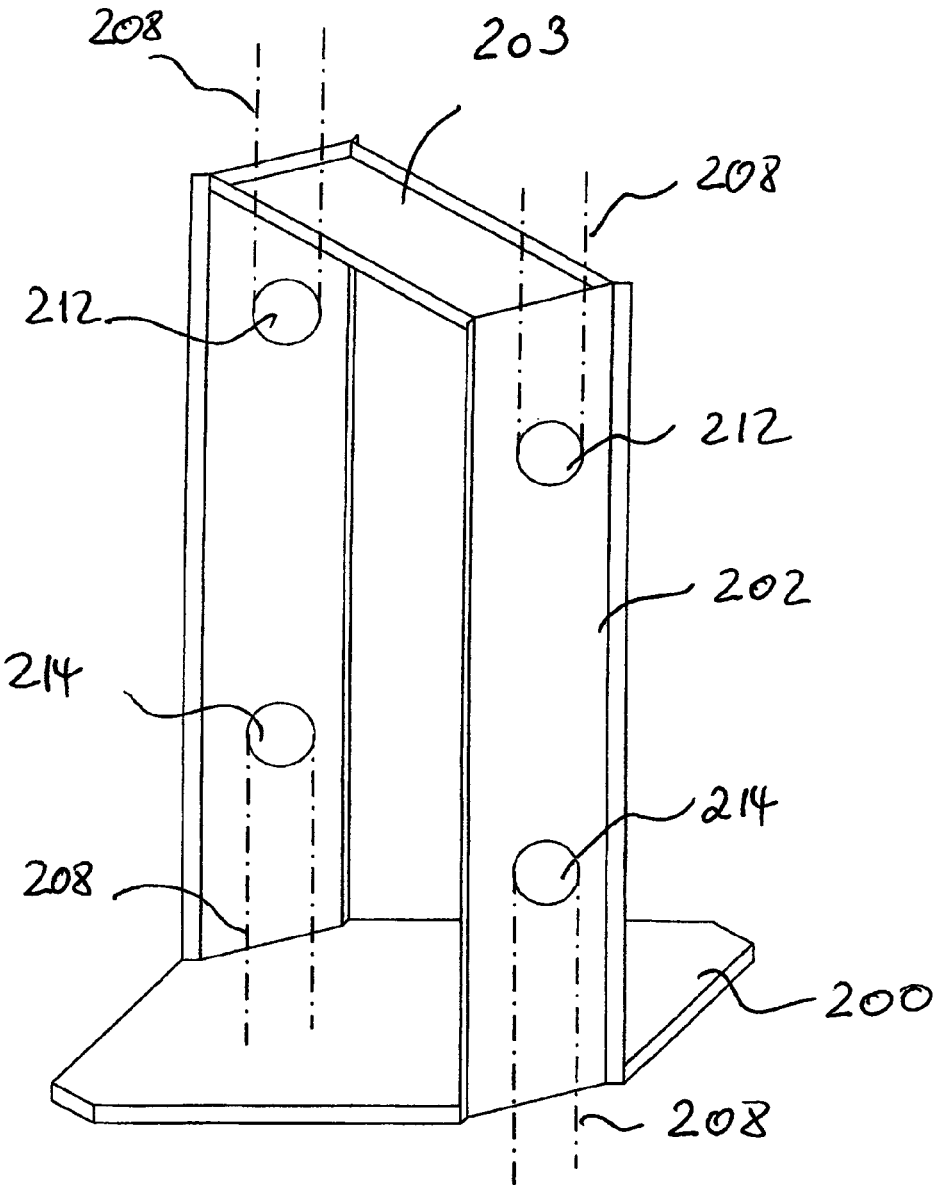
FIG. 4 shows a perspective illustration of the travel platform with oppositely arranged side parts.

According to FIG. 2*a*, a storey ceiling 116 is supported on a lower section 104 of the well carcass 102. For this purpose, the storey ceiling 116 has located in it an orifice 118 through which the load suspension means, in particular a travel platform 200 (FIG. 4), is moved vertically upward and downward with the aid of carrying means 208 (FIG. 4). The lower section 104 of the well carcass 102 stands in a well pit 114 with the aid of standing feet 112.

An upper section 106 of the well carcass 102 is located above the storey ceiling 116 and is designated as a well head 124. In this segment according to the exemplary embodiment shown in FIG. 2*a*, the drive arrangement with a drive motor 126 and with a gear, in particular a worm gear 125, is illustrated. The drive motor 126 with a drive shaft 204 may be arranged in the well head 124 of the well carcass 102 or in the well pit 114.

The upper section 106 of the elevator well carcass 102 is arranged on the storey ceiling 116. Thus, the well carcass 102 may be arranged from storey to storey or, if the orifice is of appropriate size, as a continuous structure. An overall well carcass height 120 may span a plurality of storeys, and a conveying height 122 may even amount to more than three meters.

According to FIG. 1, a load suspension means, in particular a travel platform 200, is arranged so as to be vertically moveable in the well carcass 102. The cross section of the well carcass 102 and/or of the load suspension means, in particular the travel platform 200, is of oval or polygonal, preferably square, design.

The load suspension means 200 or the travel platform designed to be square in the exemplary embodiment has at least two upright side elements 202 which lie diagonally opposite one another in the end edge region and/or in a corner region 105 of the travel platform 200 and are connected to carrying means 208. The carrying means 208 may be a rope arrangement or a rope arrangement operating on the principle of a pulley block 209.

With the aid of the pulley block 209, the amount of force to be applied, for example in order to move the elevator load, can be reduced. The pulley block is composed of fixed and/or loose deflecting pulleys or rollers and of a traction means or a rope. The toothed belt assembly obeys the same principle, except that a toothed belt is used here instead of a rope. In the rope assembly or pulley block 209 used here, according to the invention, two stationary anchorings 216 and 218 are used. However, what is always critical for the tractive force is the number of carrying ropes to which the load is distributed. In the basic form of the pulley block, as depicted, the tension $\sigma$ at each point of the rope is identical. The weight force $F_L$ of the mass is therefore distributed uniformly to all n-connections between the lower and the upper rollers and the carrying ropes. The tractive force at the end of the rope is proportional to the tension in the rope, and therefore: $F_z=F_l/n=mg/n$ applies.

The pulley block 209 according to the invention may have a step-up ratio of 1:1, 2:1, 3:1, 4:1, 5:1 or greater. Thus, inter alia, a counterweight may be dispensed with.

Figure 6:
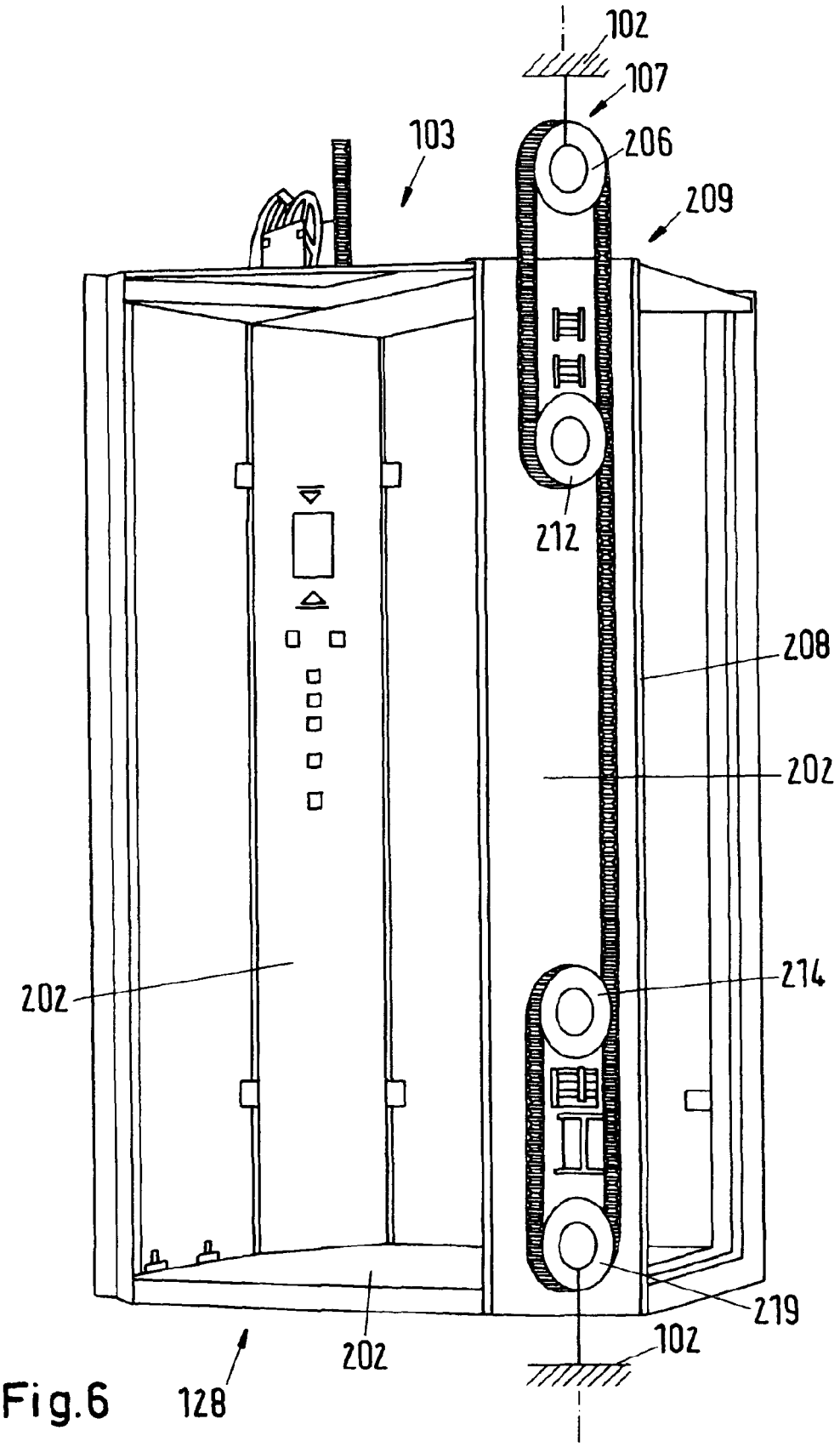
FIG. 6 shows a perspective view of a further exemplary embodiment of the travel platform with side elements and with a rope assembly arranged in the corner region of the travel platform.

The two diagonally opposite side elements 202 are connected to one another at their upper end via an upper cross piece 203. Apart from the two diagonally opposite side elements 202, the load suspension means, in particular the travel platform 200, has no further side parts. Four free access openings 128 are thus obtained. According to another embodiment according to FIG. 6, the travel platform may, in addition to the two side elements 202, have additional sidewalls formed, for example, from glass, metal or a plastic.

The load suspension means, in particular the travel platform 200, is guided vertically in the well carcass 102 with the aid of at least one guide, in particular a guide rail 220 (FIG. 7) arranged on the well carcass 102. The guide is arranged at least in a corner region 105 (FIG. 5) of the well carcass 102 and/or in the immediate vicinity of the carrying means 208, in particular of the pulley block 209.

For this purpose, the carrying frame 202 is equipped with guides 222 which extend in a vertical direction and have depressions and which are guided on the guide rail 220 (FIG. 7) arranged on the carrying frame 202 or on the side element 202. If the carrying means 208 or the drive shaft fractures, an emergency braking device 224, which is arranged fixedly on the carrying frame 202 (FIGS. 7 & 9), is activated automatically.

In the case of a square rectangular load suspension means, in particular the travel platform 200, the corner edges of the travel platform are cut off, so that the end edges of the travel platform 200 form, with two adjacent longitudinal sides 109, 111 and 113, 115 converging in a corner and with the opposite obliquely running end edge of the travel platform 200, a triangular cutout, that is to say the corner region 105, the size of which is selected such that the carrying means 208 can be accommodated in the free space. A similar procedure is adopted in the case of the other cross-sectional shapes.

Figure 5:
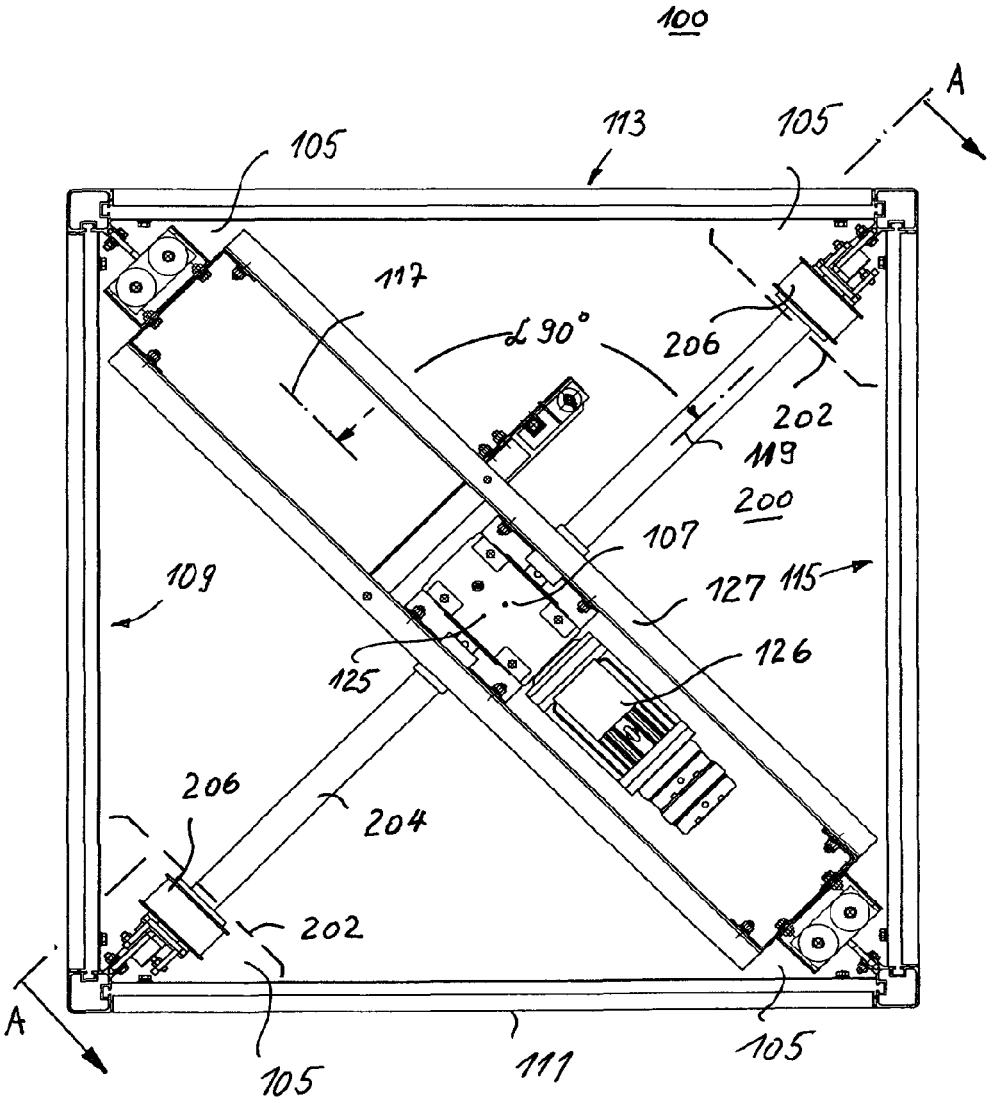
FIG. 5 shows a view of the well carcass with a drive device in the view from above according to FIG. 1.

As may be gathered from FIGS. 1 and 5, the drive motor 126 is arranged on a cross member 127 which is located in the upper well head 124. The cross member 127 is arranged between the two diagonally opposite corner regions 105 of the well carcass 102 and is connected to this. However, it is also possible to connect the cross member 127 fixedly to the corner regions 105 of the wall elements of the elevator well 100. At least one horizontally running drive shaft 204 and also two horizontally running drive shafts are connected to the drive motor 126 with the aid of the worm gear 125. Between the mutually opposite corner regions 105 of the well carcass 102 may extend a drive shaft or two drive shafts 204 oriented coaxially with one another, which are operatively connected to the drive motor 126. Furthermore, it is possible that each drive shaft is operatively connected in each case to a drive motor. Also, the drive motor may be arranged at any other angle to the drive shaft or drive shafts or at a distance from the drive shaft.

The cross member 127 and the drive shaft 204 cross one another at right angles and consequently extend in each case into the mutually opposite corner regions 105. As has already been mentioned, they are fixedly connected to the well carcass 102 or to a wall of the elevator well 100 or mounted there. By the cross member 127 and drive shaft 204 being connected to the well carcass 102, the torsional stiffness of the well carcass 102 is appreciably improved.

The drive motor 126 has an output shaft, the axis of rotation 117 of which is arranged approximately at right angles to an axis of rotation 119 of the drive shaft 204 of the carrying means, in particular the traction device 208.

The carrying means 208 assigned to the ends of the drive shafts 204 run in the immediate vicinity of and parallel to the vertically running longitudinal sides 109, 111, 113, 115 of the well carcass 102 which form the corner regions and/or to a longitudinal mid-axis 107.

Furthermore, in each case a carrying means 208 is arranged in a space-saving manner in the two diagonally opposite corner regions 105. The carrying means 208 are in each case provided between a side element 202 of the travel platform 200 and the longitudinal sides 109, 111, 113, 115 of the well carcass 102 which form the approximately triangularly designed corner region 105, or the walls of the elevator well 100.

The well carcass 102 is composed of four vertically running longitudinal sides 109, 111, 113 and 115 oriented at right angles to one another. Each longitudinal side 109, 111, 113 and 115 is composed of a rectangular frame with stanchions or longitudinal struts 129 which can be connected fixedly to one another via a plurality of cross struts or transoms 201. Depending on the embodiment, the middle cross strut 201 may be omitted, so that each longitudinal side 109, 111, 113 and 115 also has a free access opening 128 to the load suspension means, in particular to the travel platform.

In the exemplary embodiment according to FIG. 1, the access opening 128 can be closed by means of a pivotably arranged door 123. One or more access openings 128 may likewise be closed in each case with the aid of a well lining wall or a door 123. The door 123 is advantageously arranged on the well carcass 102. However, additional doors may also be arranged on the platform or travel platform on an operator's car, not illustrated here.

The travel platform 200 is preferably designed to be square, and the carrying means 208 assigned to the ends of the drive shafts 208 run in the immediate vicinity of and parallel to the vertically running longitudinal sides 109, 111, 113, 115 of the well carcass 102 which form the corner regions.

The traction device 208 operates on the principle of a pulley block and is therefore designated below as a pulley block 209. It has one or more deflecting pulleys 206, 212, 214, 219.

The carrying means 208 arranged on both sides of the travel platform 200 run from the end suspension or anchoring 216, provided in the well head 124 and connected to the wall of the elevator well 100 or to the well carcass 102, via the deflecting pulley 212 to the driving pulley 206 and from there further on via the deflecting pulley 219 located in the well pit 114 or connected fixedly to the wall of the elevator well 100 or to the well carcass 102 with the aid of the anchoring 218. The carrying means 208 runs from there further on via the deflecting pulley 214 arranged on the side element or carrying frame 202 to the end suspension or anchoring 218 which is fastened either to the well carcass 102 or in the well pit 114.

The driving pulley 206 and the individual deflecting pulleys 212, 214, 219 all have the same diameter so that no different curvature loads on the carrying means occur. The carrying means 208 are bent only in the same direction, that is to say they do not undergo any counter bending, but only codirectional bending. In the exemplary embodiment, the carrying means 208 are all bent clockwise. As seen from the end suspension 218 in the direction of the storey ceiling 216, the carrying means in FIG. 7 experiences only a right-handed bend. So that the carrying means do not rub against one another, for example, the deflecting pulleys 212, 214 are arranged so as to be slightly offset laterally with respect to the driving pulley and to the stationary deflecting pulleys 219 according to FIG. 8.

Figure 7:
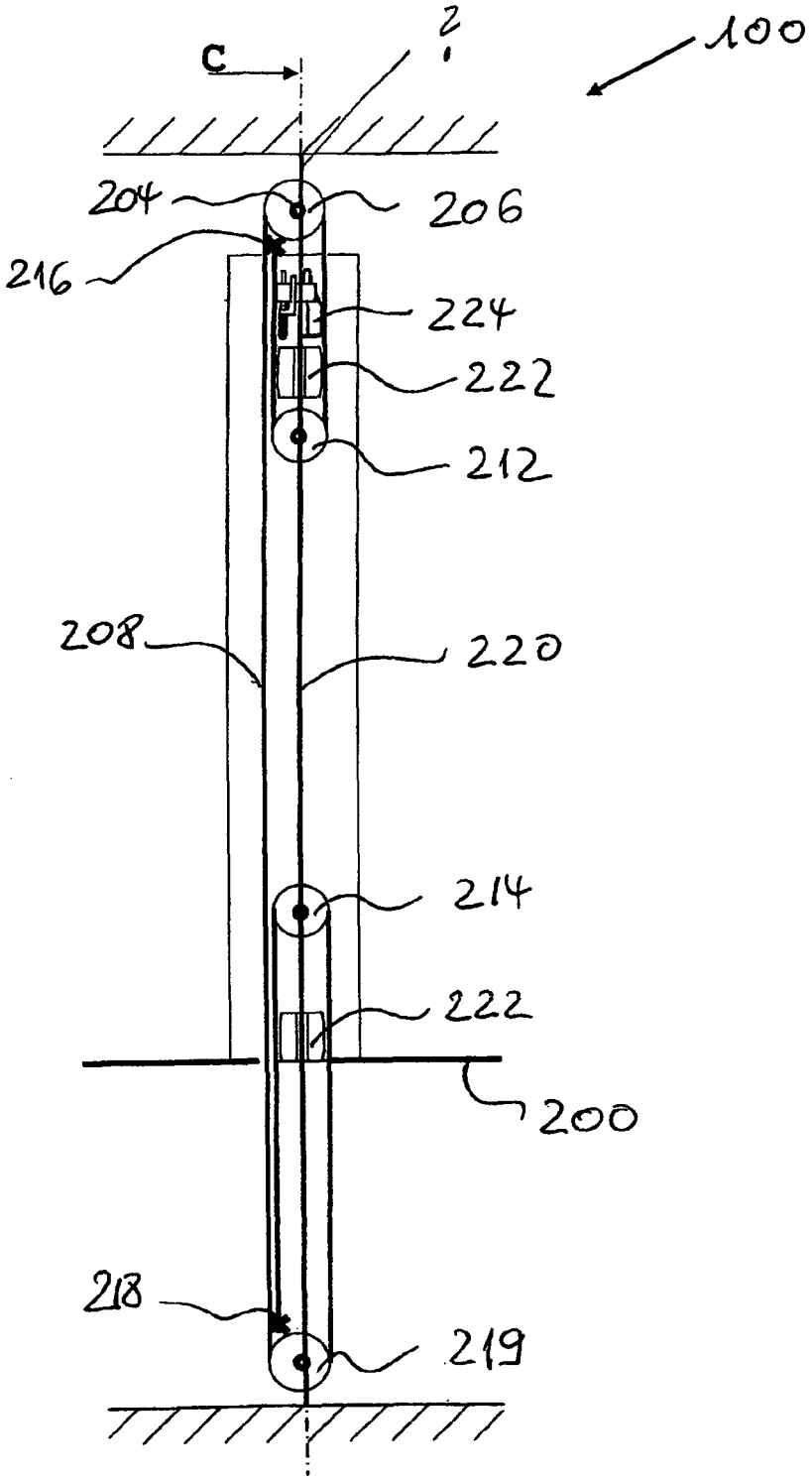
FIG. 7 shows a diagrammatic illustration of the rope assembly according to FIG. 6 in a side view.
Figure 8:
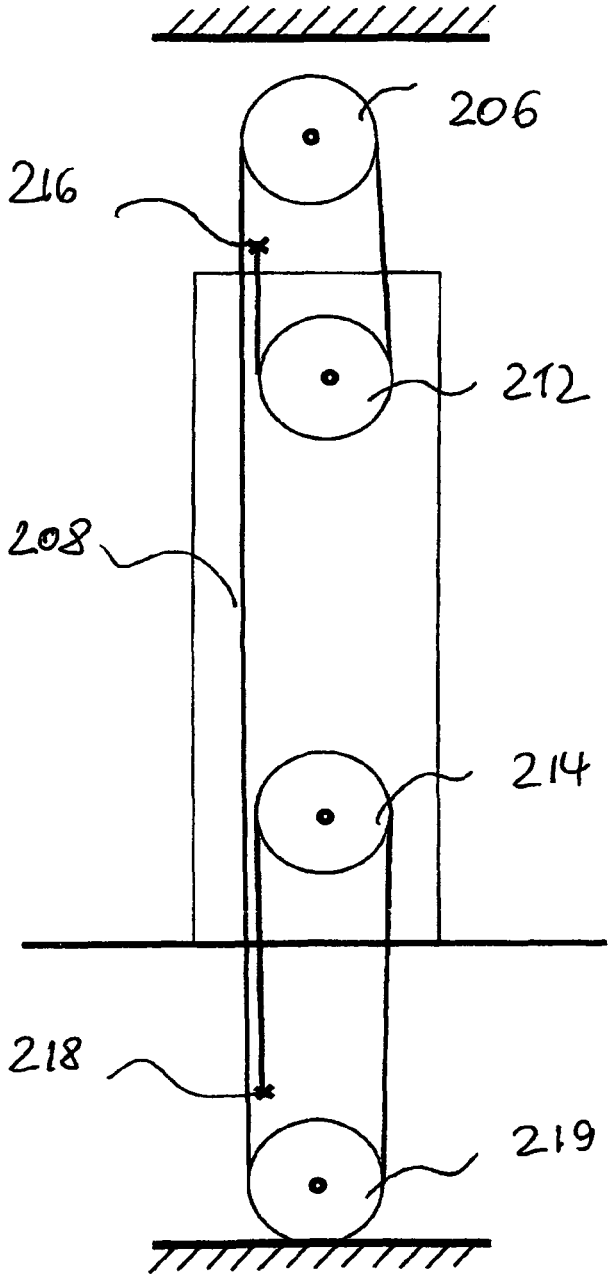
FIG. 8 shows a further exemplary embodiment of the rope assembly according to FIG. 6 in a side view.

All the axes of the driving pulley 206 and of the deflecting pulleys 212, 214, 219 are arranged, according to FIG. 7, one below the other approximately on a vertically running plane. The pulley block can therefore be accommodated very easily in the corner region of travel platform 200 and well carcass 102 in a simple and space-saving manner. The driving pulley 206 or the deflecting pulleys 212, 214, 219 may, for example, be grooved driving pulleys, chain pinions or toothed belt pulleys.

Figure 9:
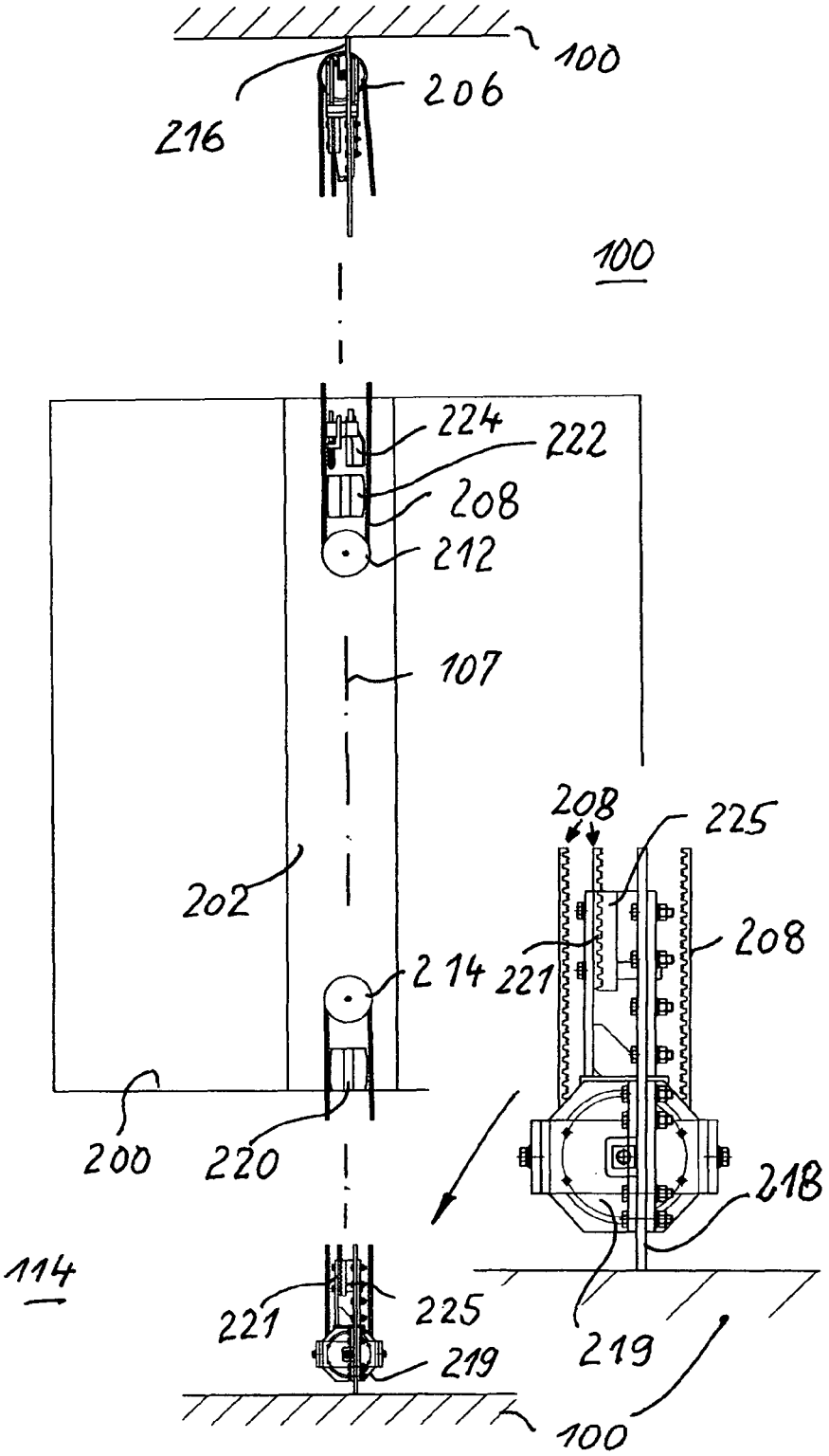
FIG. 9 shows a part view of the rope assembly with a toothed belt which is guided via an upper driving pulley and a lower deflecting pulley.

The illustration according to FIG. 9 shows a diagrammatic side view. The carrying means 208 run via the driving pulleys 206 mounted at the ends of the drive shaft 204 to the deflecting pulleys 212, 214 located on the carrying frame 202 and to the deflecting pulley in the well pit 219 and to the end suspensions 216 and 218. The carrying means 208 used may, for example, be steel ropes with or without plastic sheathing, toothed belts or steel chains.

Figure 2B:
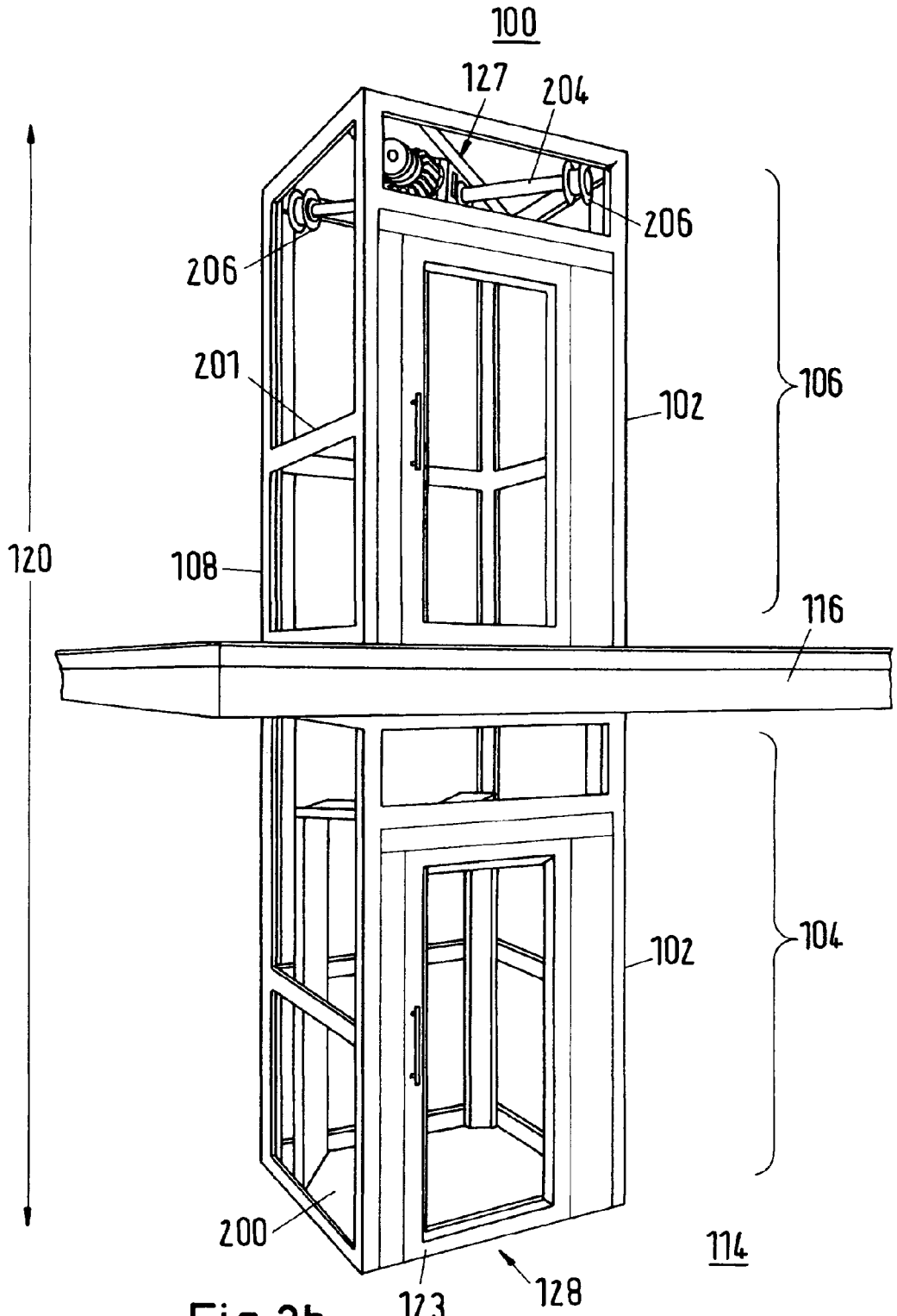
Figure 3:
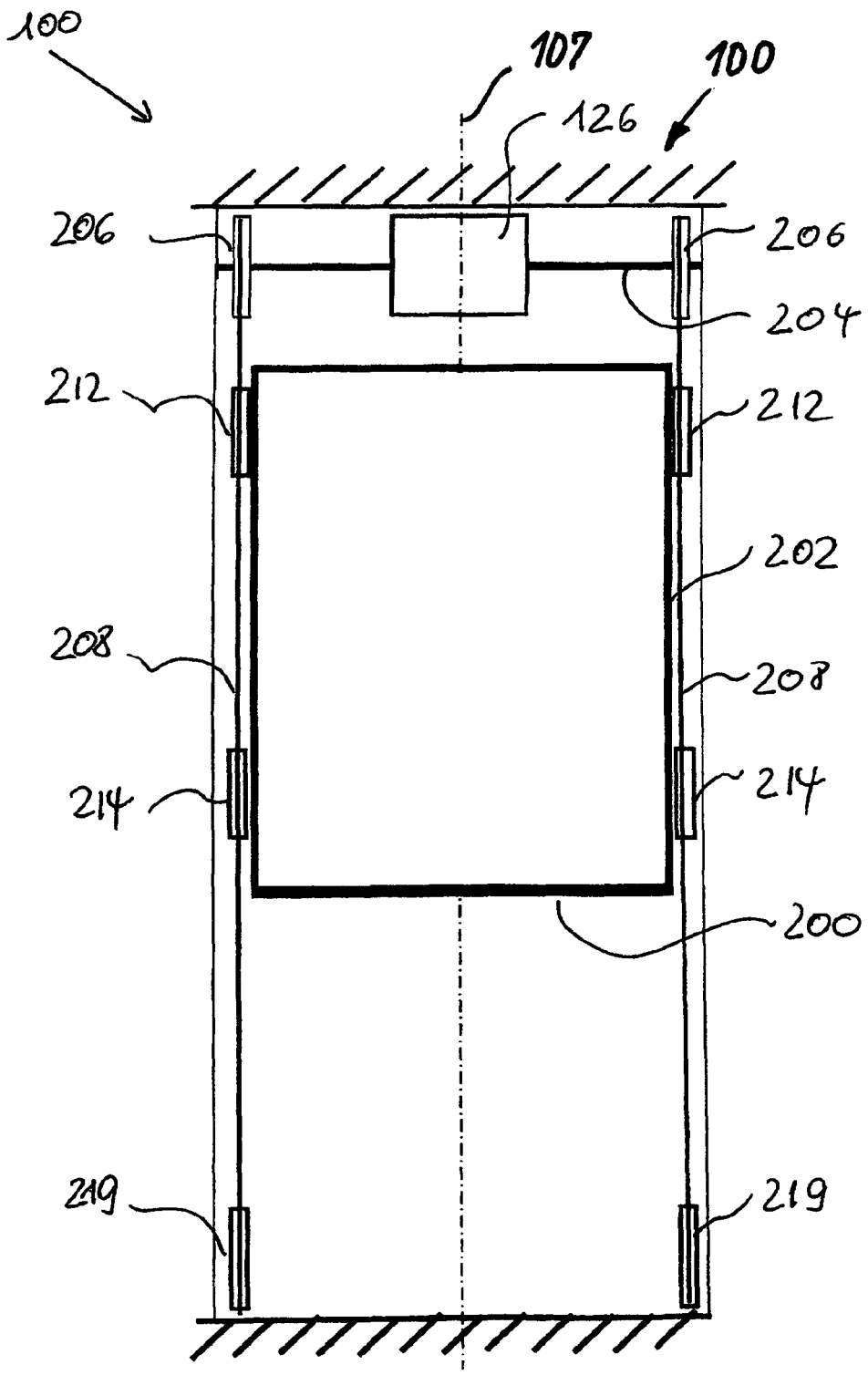
FIG. 3 shows a longitudinal section of the well carcass along the drive shaft.

The driving pulley 206 or the driving pulley 206 connected to the drive shaft 204 (FIG. 7) is mounted in the elevator well 100 or in the well carcass 102 in the region of the well head 124 (FIG. 2) above the travel platform 200. A further deflecting pulley 219 is mounted below the elevator installation 103 in the section 104 in the elevator well or on the well carcass 102. One or more, in particular two, deflecting pulleys 212, 214 are mounted in or on the side elements 202 of the travel platform 200.

The anchoring 216 for the traction means 208 of the pulley block 209 is connected in the elevator well 100 or on the well carcass 102 above the elevator installation 103, and a further anchoring 218 for the traction means of the pulley block 209 is connected below the elevator installation 103 in the elevator well 100 or in the well carcass 102.

According to FIG. 9, the anchoring 218 may have in each case two flat pieces 221, 225 which are held together by screw bolts and the flat piece 225 of which has a toothing. The carrying means 208 can be clamped between the flat pieces 221, 225. A prestressing of the traction means is thus achieved.

Figure 10:
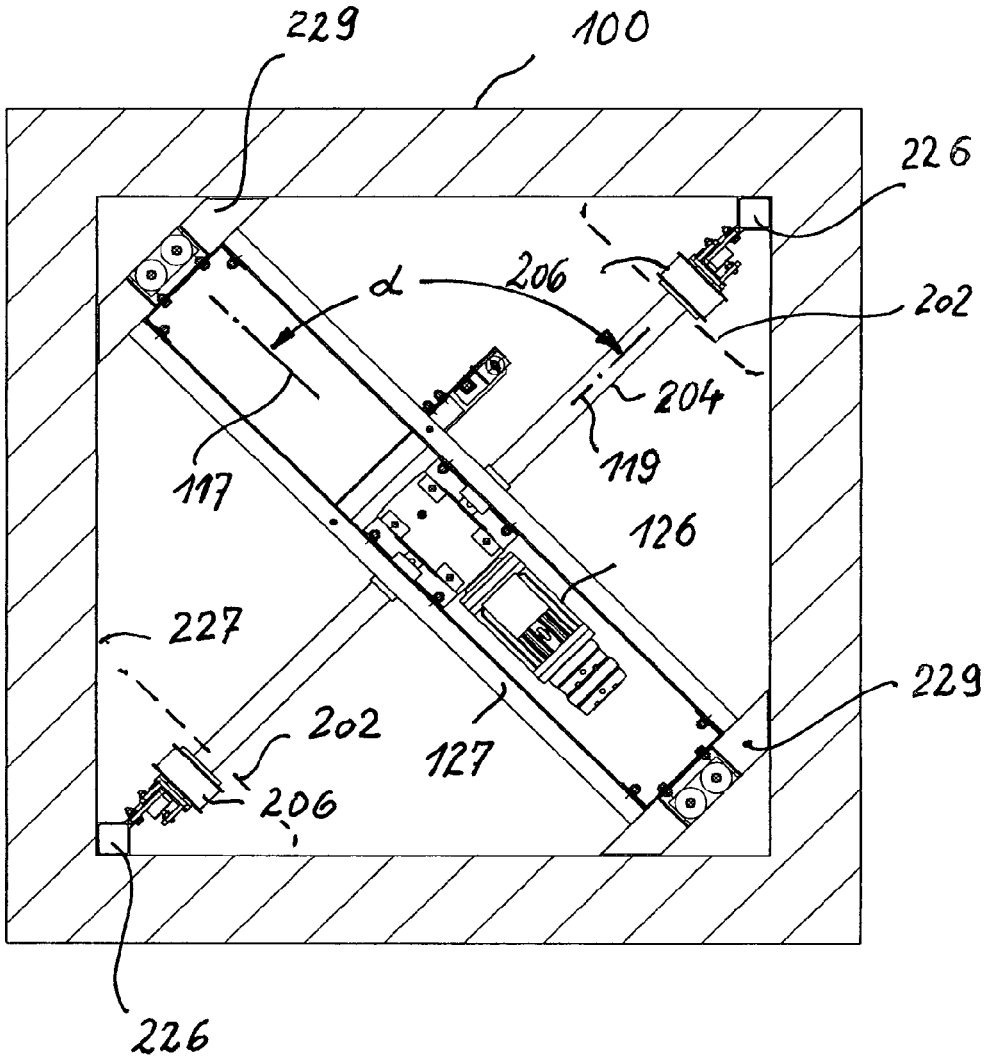
FIG. 10 shows a view of a further exemplary embodiment of the well carcass with a drive device in the view from above according to FIG. 1.

According to a further exemplary embodiment shown in FIG. 10, contrary to the embodiment according to FIGS. 1 and 5, the well carcass 102 may be composed of at least two diagonally opposite vertically running stanchions 226 of rectangular cross section. The stanchions 226, because of their rectangular cross section, can very easily be connected indirectly or directly to at least one inner wall 227 of the elevator well 100 in the corner region 105 of the well carcass 102 and, in addition, can stand on the floor of the elevator well 100. Furthermore, the stanchions 226 may even be dispensed with if the guide rails 107 are fastened by means of holders 230 directly to the well walls or to the inner wall 227 of the elevator well 100.

Furthermore, the cross member 127 can also be connected in the corner region 105 of the well carcass 102 indirectly or directly to at least one inner wall 227 of the elevator well 100 and, in particular with the aid of a holder 229, be fastened to the inner wall 227 in a space-saving manner.

The carrying means 208, guide rails 220 and at least one upper and one lower deflecting pulley 206, 219 are arranged indirectly or directly on the stanchions 226.

The axis of rotation 117 of the drive motor 126 and the axis of rotation 119 of the drive shaft 204 form an angle $\alpha$ of 90° according to FIGS. 5 and 10. If, however, the cross-sectional area of the well carcass 102 or of the elevator well 100 has a cross-sectional shape deviating from the rectangular cross section, the angle $\alpha$ may be larger of smaller than 90°.

Figure 11:
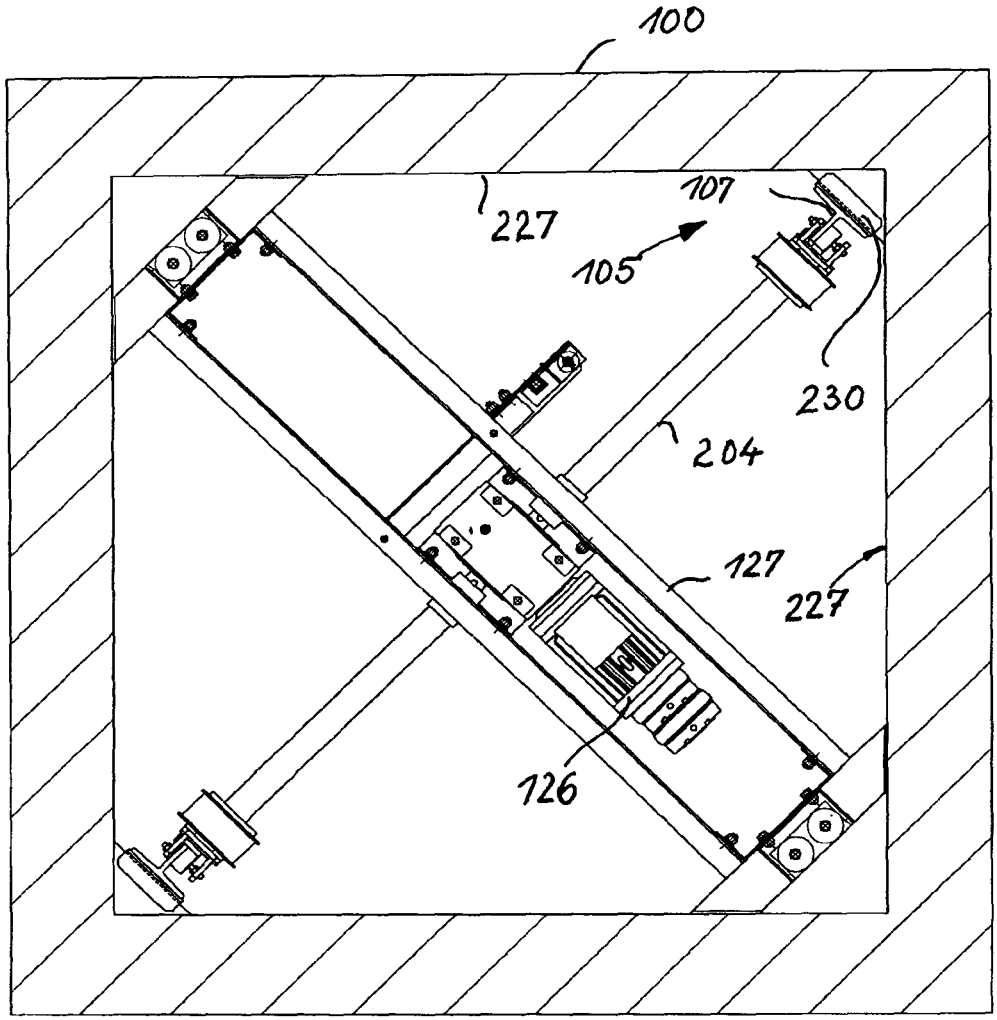
FIG. 11 shows a view of a further exemplary embodiment of the well carcass with a drive device in the view from above according to FIG. 1.

According to a further exemplary embodiment shown in FIG. 11, the guide rails 102 may be fastened in the corner region 105 to the well walls or to the inner wall 227 of the elevator well 100 directly and/or with the aid of a holder 230. As may be gathered from FIGS. 5 and 11, the guide rail 102 is designed as a T-rail, and the rail foot is connected fixedly to the well walls or to the inner wall 227 of the elevator well 100. The rail web of the guide 222 designed as a T-rail serves for the displaceable reception of the guide 222 arranged on the carrying frame or side element 202.

LIST OF REFERENCE SYMBOLS

100 Elevator well
102 Well carcass
103 Elevator installation
104 lower section
105 Corner region
106 upper section
107 Longitudinal mid-axis
109 Longitudinal side
111 Longitudinal side
112 Standing foot
113 Longitudinal side
114 Well pit
115 Longitudinal side
116 Storey ceiling
117 Axis of rotation of the drive motor
118 Opening
119 Axis of rotation of the drive shaft
120 Well carcass height
122 Conveying height
123 Door
124 Well head
125 Gear, worm gear
126 Drive motor
127 Cross member
128 Access opening
129 Stanchion, longitudinal strut
200 Load suspension means, travel platform
201 Cross strut, transom
202 Carrying frame, side element
203 Cross piece
204 Drive shaft
206 Deflecting pulley, driving pulley
208 Carrying means, in particular traction device, preferably rope traction device for a pulley block 209, in particular a factor pulley block
209 Pulley block
212 Deflecting pulley
214 Deflecting pulley
216 Anchoring, upper end suspension
218 Anchoring, lower end suspension
219 Deflecting pulley
220 Guide rail on the well carcass 102
221 Flat piece
222 Guide on the travel frame
224 Emergency braking device
225 Flat piece, toothing
226 Stanchion
227 Inner wall
229 Holder
230 Holder

The invention claimed is:

1. A well carcass for an elevator installation, which well carcass may be arranged so as to be free-standing and/or in an elevator well and serves for receiving a travel platform which is moved upward and downward in the well carcass with the aid of carrying means via at least one drive shaft connected to a drive motor and mounted horizontally on the well carcass or in the elevator well, wherein at least one drive shaft extends diagonally and approximately horizontally between a first corner and a second corner diagonally opposite the first corner of the well carcass, and respective ends of the at least one drive shaft being connected indirectly or directly to opposite parts of the well carcass or wall parts of the elevator well and having in a region of each of its respective ends a driving pulley which moves the travel platform upward and downward in each case with the aid of the carrying means, and wherein the first corner and the second corner each comprises a free space framed by a first vertically running side of the well carcass, a second vertically running side of the well carcass, and an upright side element of the travel platform.

2. The well carcass as claimed in claim 1,
wherein
the cross section of the well carcass and/or of the travel platform is of oval or polygonal design, and the carrying means assigned to the respective ends of the drive shaft run in the immediate vicinity of and parallel to at least vertically running longitudinal sides of the well carcass which form the first and second corners.

3. The well carcass as claimed in claim 2,
wherein
the cross section of the well carcass and/or of the travel platform is of oval design.

4. The well carcass as claimed in claim 2,
wherein
the cross section of the well carcass and/or of the travel platform is of square design.

5. The well carcass as claimed in claim 1,
wherein the at least one driveshaft is operatively connected to the drive motor, and
wherein the carrying means are connected to the drive pulleys at points positioned directly above the first and second corners.

6. The well carcass as claimed in claim 1,
wherein
the drive motor has an output shaft, the axis of rotation of which is arranged approximately at right angles to an axis of rotation of the driveshaft of the carrying means.

7. The well carcass as claimed in claim 1,
wherein
the upright side elements of the travel platform each stand upright in an end edge region and/or in a corner region of the travel platform and which are connected to the carrying means.

8. The well carcass as claimed in claim 1,
wherein
the carrying means is arranged between upright side elements of the travel platform and longitudinal sides of the well carcass which form the free space of the first corner.

9. The well carcass as claimed in claim 1,
wherein
the carrying means comprises a pulley block having one or more deflecting pulleys.

10. The well carcass as claimed in claim 9,
wherein
the deflecting pulleys have axes arranged one below the other approximately on a vertically running plane.

11. The well carcass as claimed in claim 9,
wherein
the pulley block further comprises chains, steel ropes or toothed belts, which are tensioned with the aid of a clamping and/or a tensioning device.

12. The well carcass as claimed in claim 9,
wherein
the pulley block has a step-up ratio of at least 1:1.

13. The well carcass as claimed in claim 9, wherein the pulley block comprises a toothed belt bent in only one direction on all the deflecting pulleys.

14. The well carcass as claimed in claim 1, wherein the travel platform is guided in the well carcass with the aid of at least one guide arranged on the well carcass, the at least one guide being arranged at least one of the first corner and second corner of the well carcass and/or in the immediate vicinity of the carrying means.

15. The well carcass as claimed in claim 1, wherein the drive motor, together with the driveshaft, is arranged in a wellhead of the well carcass or in a wellpit.

16. The well carcass as claimed claim 1, wherein the travel platform comprises upright frame parts arranged in at least one of the first corner and second corner of the travel platform in such a way that a free access opening is present on at least four sides.

17. The well carcass as claimed in claim 1, wherein one or more access openings on the travel platform can be closed with the aid of car walls and/or doors.

18. The well carcass as claimed in claim 1, wherein the well carcass is composed of at least two diagonally opposite vertically running stanchions, on which the carrying means, guide rails and at least one upper and one lower deflecting pulley are arranged indirectly or directly.

19. The well carcass as claimed in claim 1, wherein the well carcass and/or the diagonally opposite vertically running stanchions and/or the cross member in the corners of the well carcass are/is connected indirectly or directly to at least one inner wall of the elevator well.

20. The well carcass as claimed in claim 1, wherein the at least one guide is fastened directly and/or with the aid of a holder to the well carcass or to an inner wall of the elevator well.

* * * * *